US005649695A

United States Patent [19]

Lawrence

[11] Patent Number: 5,649,695

[45] Date of Patent: Jul. 22, 1997

[54] CONTINUOUS SHEET STACKER AND FINISHER

[75] Inventor: Frederick J. Lawrence, Tustin, Calif.

[73] Assignee: Gradco (Japan) Ltd., Tokyo, Japan

[21] Appl. No.: 594,050

[22] Filed: Feb. 1, 1996

[51] Int. Cl.[6] ..... B65H 39/02

[52] U.S. Cl. ..... 270/58.12; 270/58.13; 270/58.27; 270/58.28

[58] Field of Search ..... 270/58.08, 58.11, 270/58.12, 58.13, 58.27, 58.28

[56] References Cited

U.S. PATENT DOCUMENTS

| | | | |
|---|---|---|---|
| 4,566,782 | 1/1986 | Britt et al. | 355/14 SH |
| 4,878,656 | 11/1989 | Honjo et al. | 270/53 |
| 4,898,372 | 2/1990 | Hirabayashi et al. | 270/58.12 |
| 4,925,172 | 5/1990 | Christy et al. | 270/58.12 |
| 5,020,784 | 6/1991 | Asami et al. | 270/58.11 |
| 5,021,837 | 6/1991 | Uto et al. | 270/58.28 X |
| 5,125,634 | 6/1992 | Lawrence | 270/53 |
| 5,388,819 | 2/1995 | Ushirogata | 270/58.11 X |

*Primary Examiner*—Hoang Nguyen
*Attorney, Agent, or Firm*—Newton H. Lee, Jr.

[57] ABSTRACT

A continuous sheet stacker and finisher apparatus and method are disclosed in which sets of sheets delivered from a sheet printer or copier are collected at an assembly station, moved to a stapling position and finished prior to deposit on a stack of previously finished sets. The set assembling continues during movement of a previously collected set to the stapling station and then to a stacker in which the finished sets are collected during the period of time that a printer or copier is supplying a new set of sheets to the sheet assembly station.

14 Claims, 9 Drawing Sheets

CONTINUOUS SHEET STACKER AND FINISHER

BACKGROUND OF THE INVENTION

Sheet handling equipment has heretofore involved the collating or sorting of sheets in sorting machines in separated sets or the collection of sets of sheets for finishing and depositing in a stacker in a stack of finished sets.

In some cases, the devices for receiving and collating the sets of sheets have included finishing or stapling devices in which sets of sheets are received in a receiver tray, finished or stapled while in the receiver tray and then deposited in a collector or stacker. In other cases the sets of sheets are individually collected in a sorting machine having plural trays, in which case the stapler may be moved to the respective trays for finishing the sets or the sets may be displaced from the sorter trays and moved to a stapler.

However, in the case of such prior devices, the finishing or stapling operation is accomplished following the completion of the successive sets of sheets in a subsequent finishing or stapling operation, so that rate of speed at which all of the collective functions, including the collection of sets, the finishing or stapling of sets and the deposition of the finished sets in a stacker or the return of a finished set to a sorter tray are all performed in sequence. This results in loss of time for the performance of the several independent functions.

PRIOR ART

Examples of prior devices which independently perform the several functions of collecting sets of sheets, finishing the sets and either retaining the sets in sorter trays or depositing the finished sets in a stack are disclosed in the prior art.

In my prior U.S. Pat. No. 5,125,634, previously collected sets of sheets are gripped and transferred to a stapling position from the respective sorter trays, stapled and returned to the sorter tray. In this case, the moving trays are moved vertically to the stapling station after all of the sets of sheets have been collected in the respective trays of the apparatus.

In U.S. Pat. No. 4,566,782 a different approach is illustrated wherein a stapler is moved vertically relative to a stack of fixed trays and previously formed sets of sheets are stapled at the respective trays.

In U.S. Pat. No. 4,878,656 a system and method are illustrated whereby the sets are sequentially accumulated on a receiver tray, stapled and then moved from the receiver tray to a stack of finished sets.

As is apparent in all of the foregoing exemplary disclosures, all of the sheet handling, finishing or stapling and stacking operations are performed independently of the other and each operation is performed in sequence before commencement of the following operation.

SUMMARY OF THE INVENTION

In accordance with the present invention sheet handling apparatus and a method are provided wherein sheets are supplied to a receiving or set assembling station at which the sheets are collected in sets, then aligned and moved from the receiving station to a finishing or stapling station, while the receiving station receives sheets to form the next set during the period that the first set is finished or stapled in one or more locations and then moved to a stack, and these operating steps can be repeated. This is to say, the second set being formed during the period that the first formed set is moved to the stapling station and then to the stack, can be transferred from the receiving station to the stapling station during the period that a third set of sheets is being formed at the receiving station.

Such continuous feeding of sheets to a receiver during the period of time that previously formed sets are being finished and stacked materially enhances the ability of the printer or copier to relatively continuously operate to supply sheets to the receiver during conduct of the secondary finishing and stacking functions. Thus, the combined assembling, finishing and stacking operations can be performed at relatively high feed rates of the host printer.

During the stacking operation, the stapled sets are moved to the stacker and deposited in offset relation to one another to assist in set separation.

The present invention has other features and advantages which will become readily apparent to those skilled in the art by reference to the detailed description of an illustrative embodiment of an apparatus and method and the accompanying drawings forming a part hereof.

DESCRIPTION OF THE PREFERRED EMBODIMENT

Figure 4:
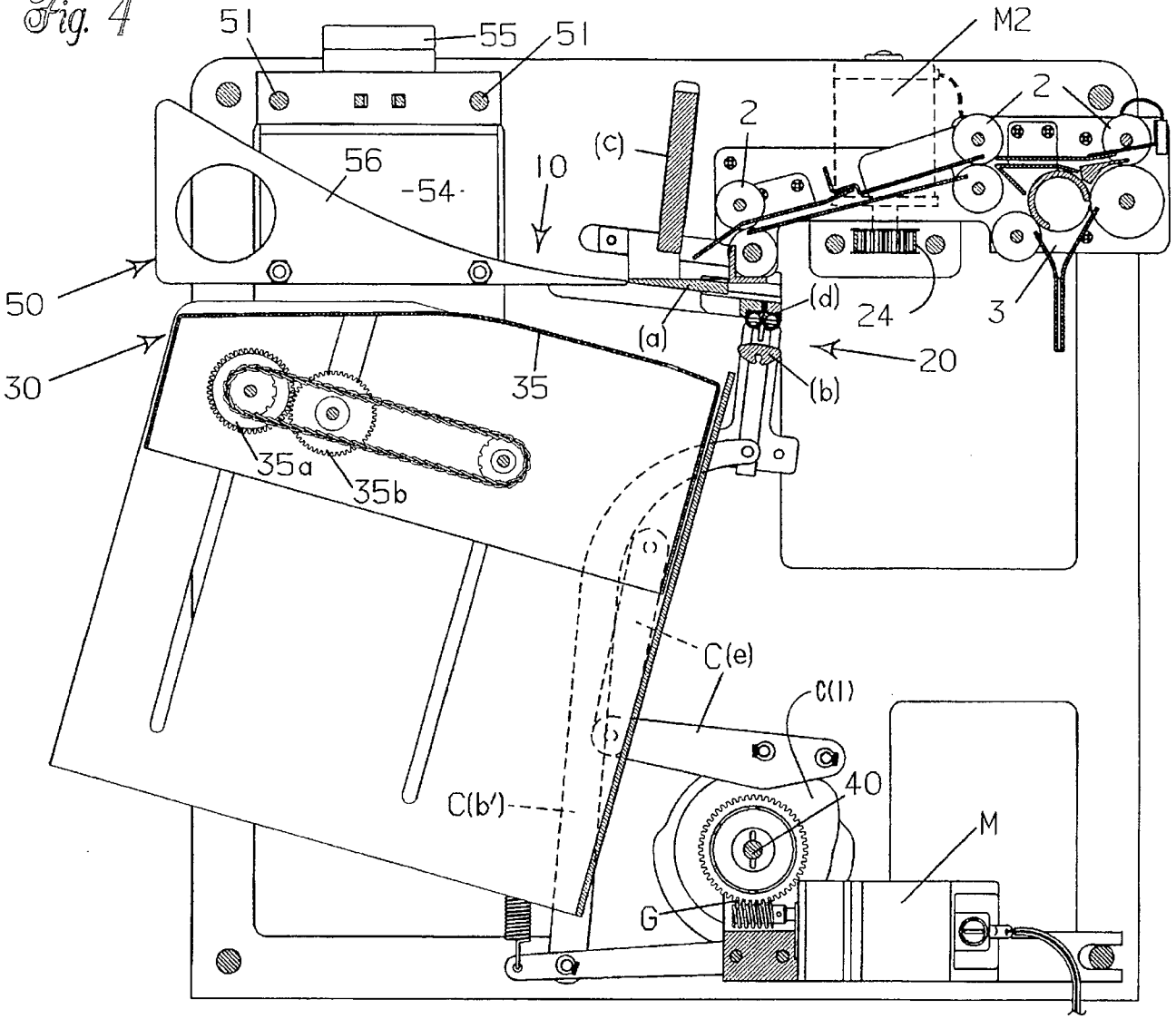
FIG. 4 is a vertical section on the line 4—4 of FIG. 2.
Figure 5:
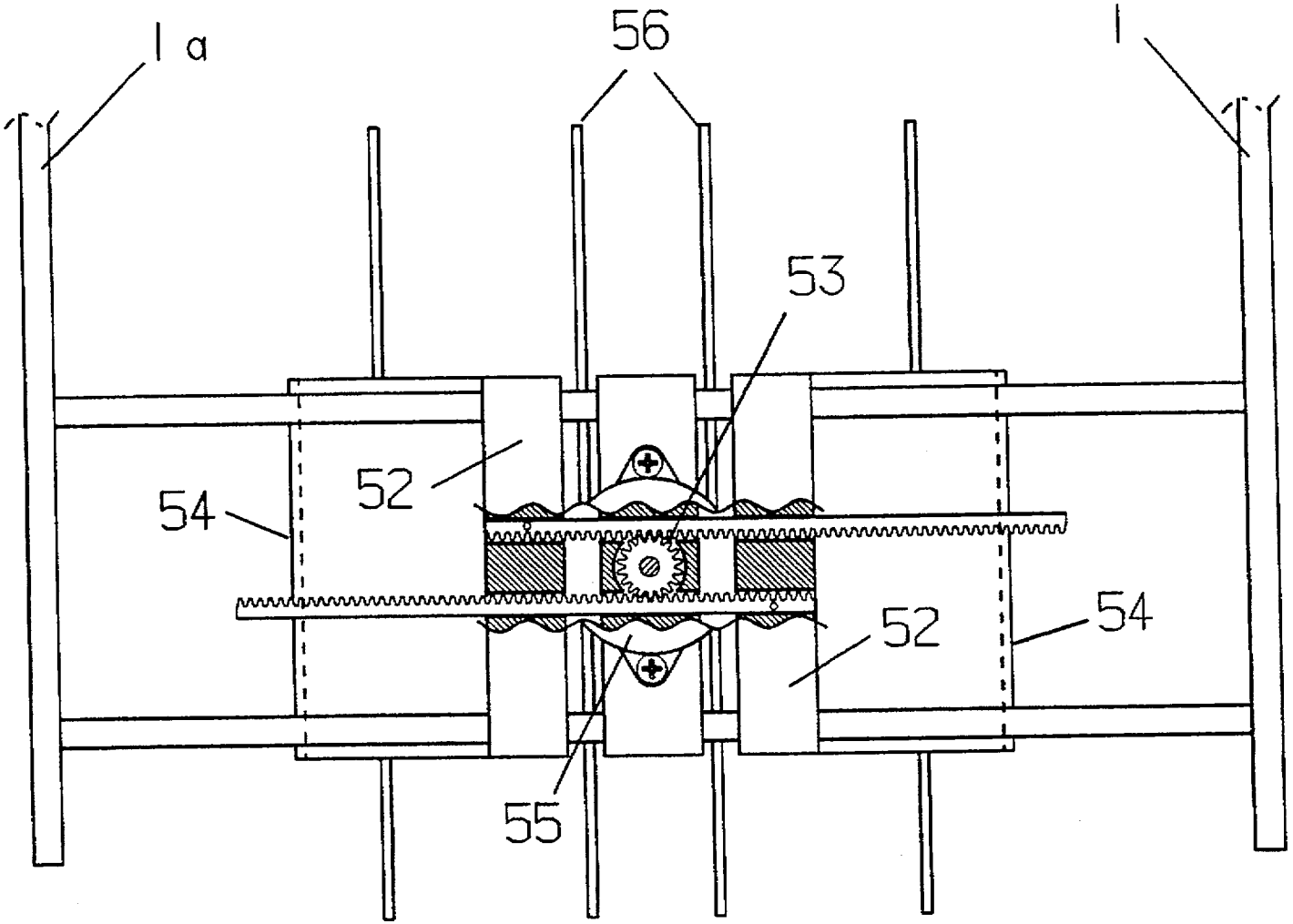
FIG. 5 is a partial top view better illustrating the leading end support and jogger for the sheets.
Figure 6:
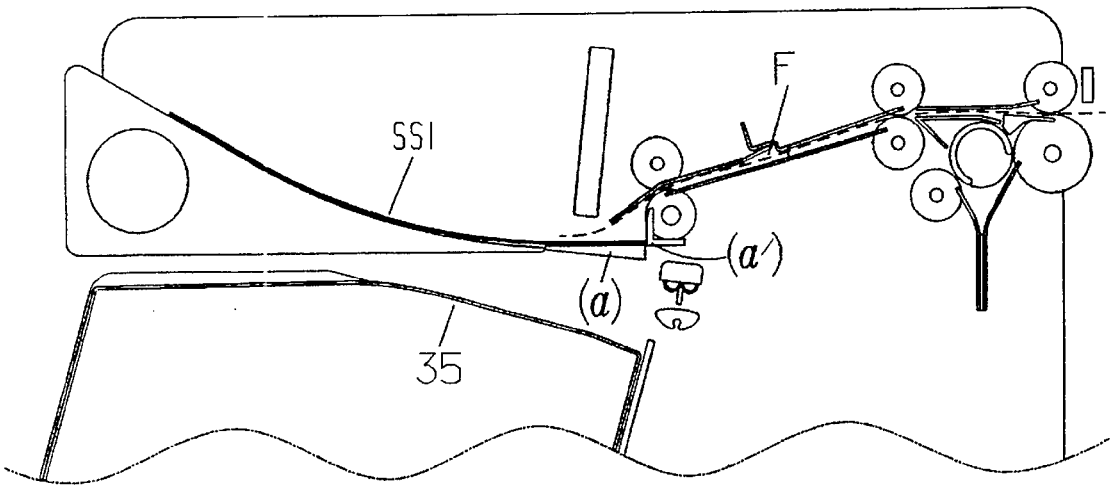
FIGS. 6(*a*) through 6(*l*) are views respectively illustrating the step by step functioning of the apparatus in the performance of the method of the present invention.
Figure 6:
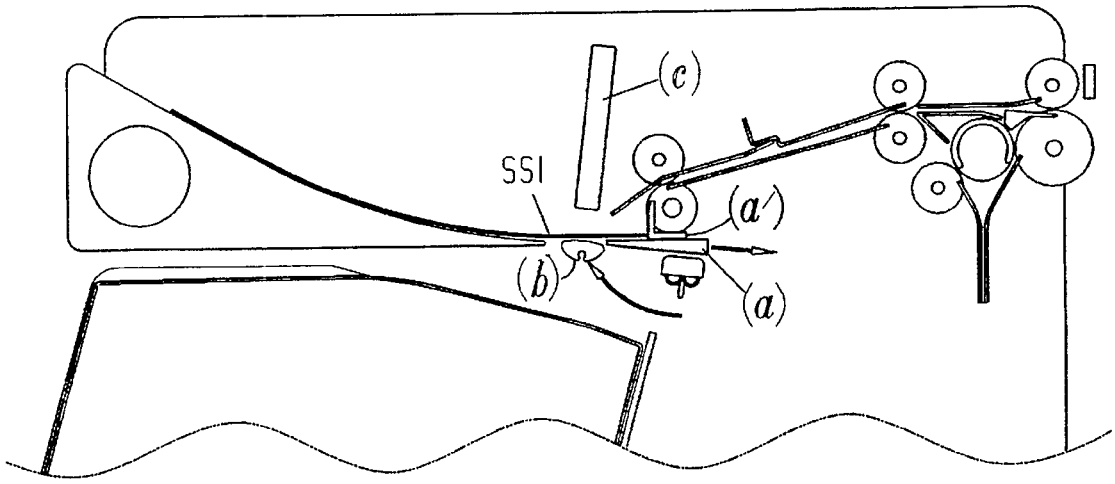
Figure 6:
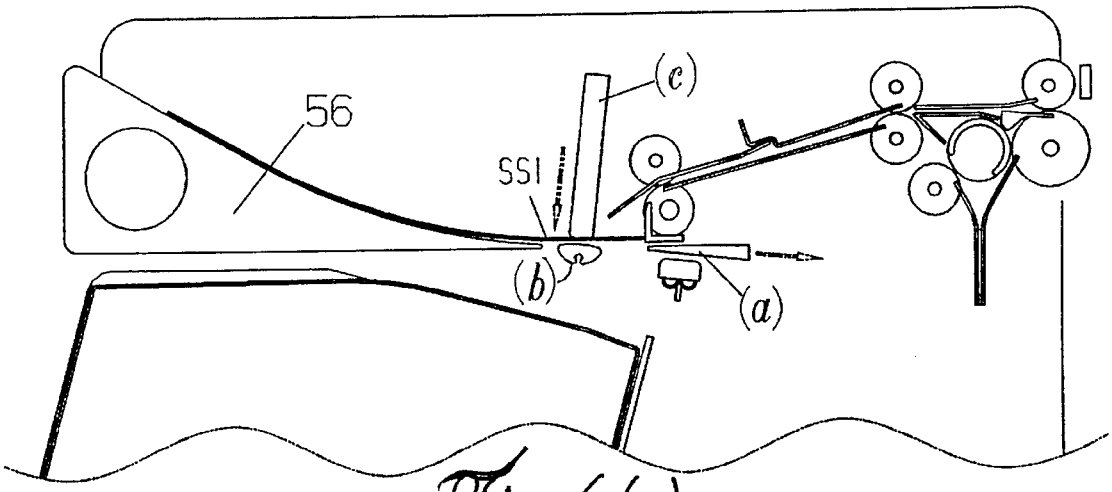
Figure 6:
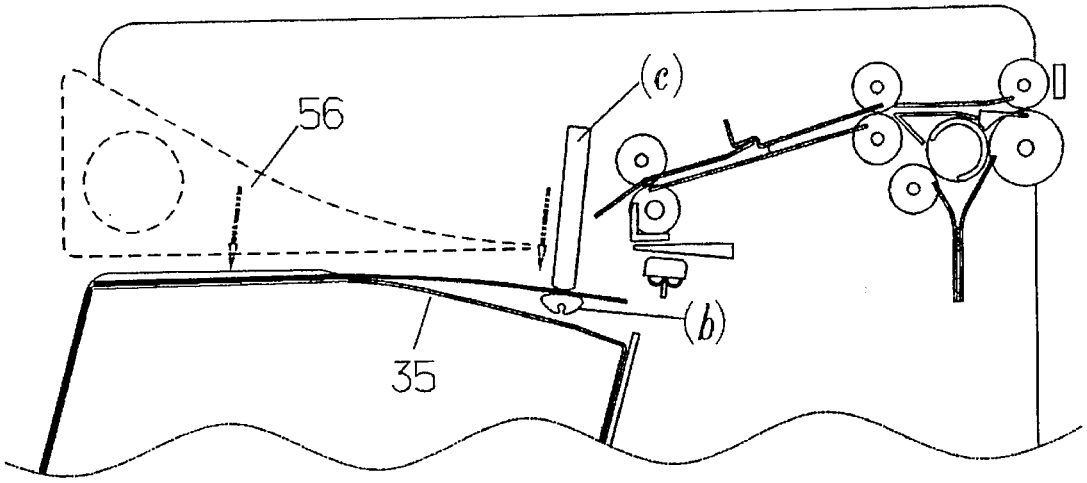
Figure 6:
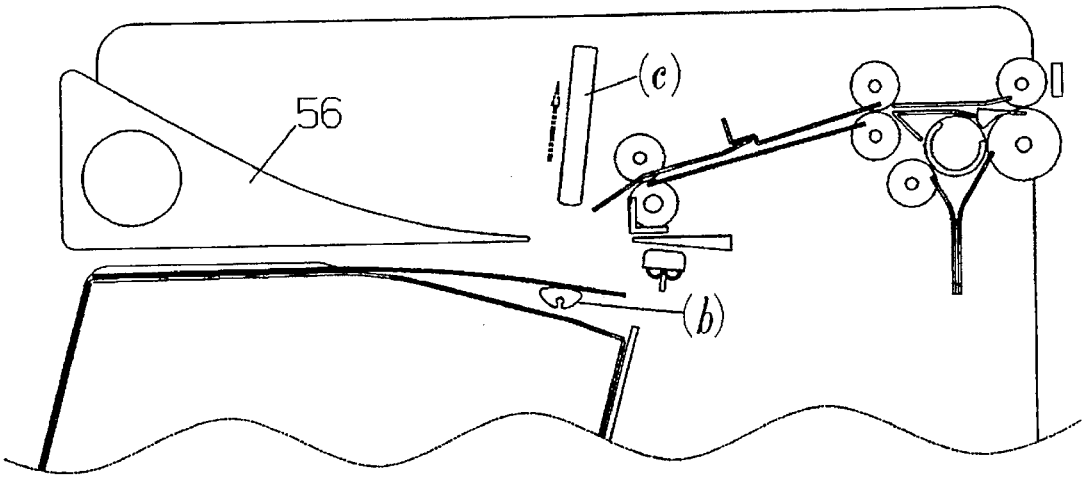
Figure 6:
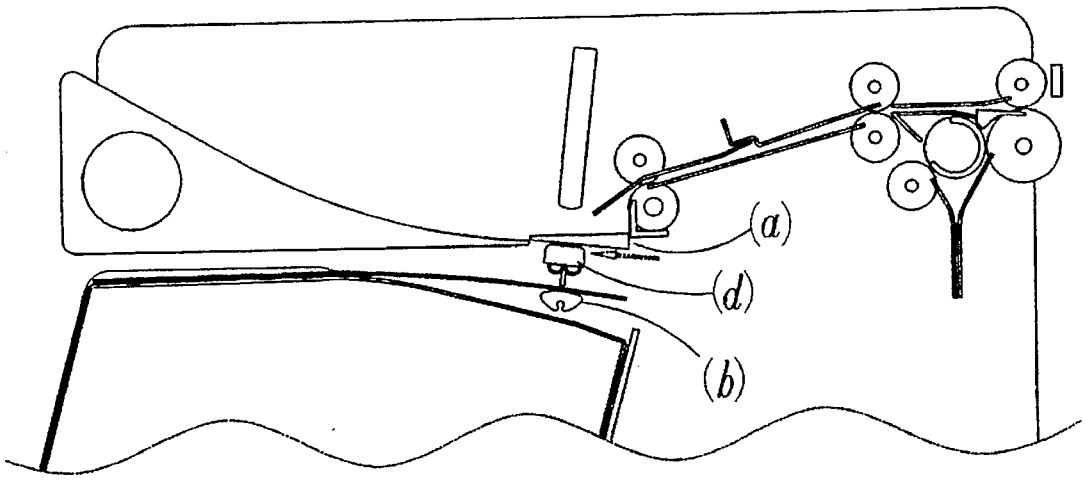
Figure 6:
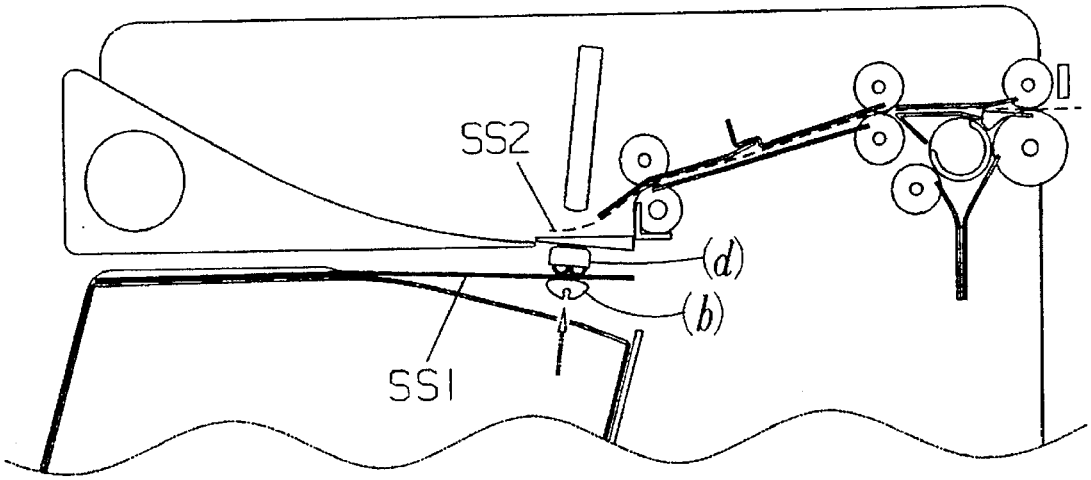
Figure 6:
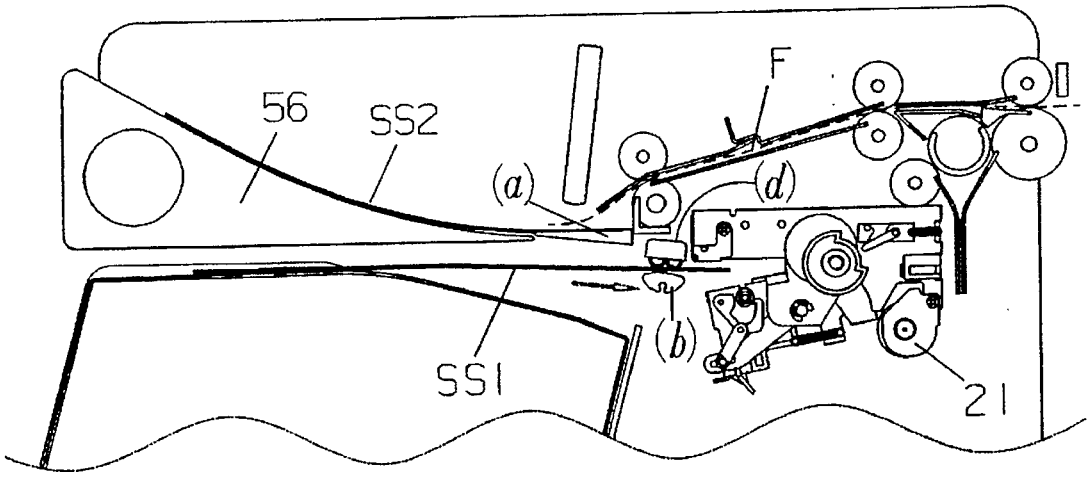
Figure 6:
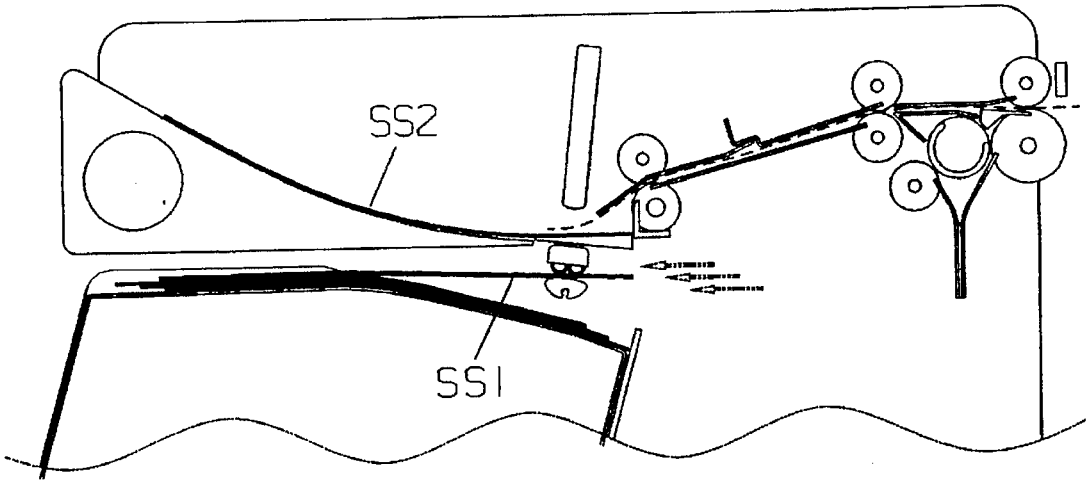
Figure 6:
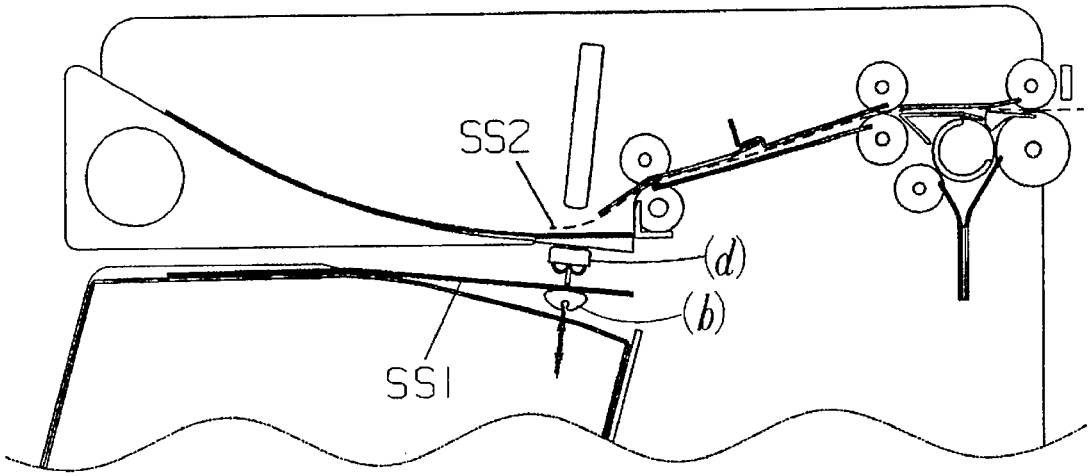
Figure 6:
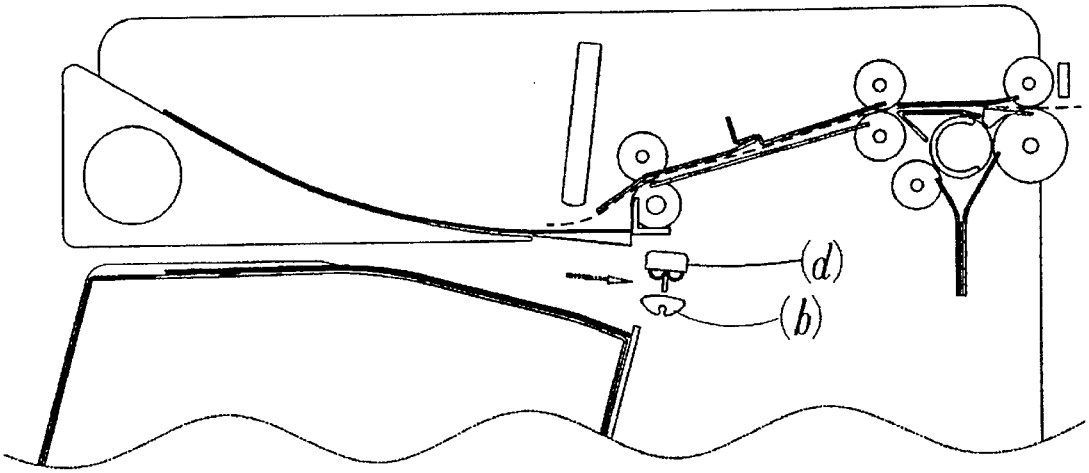
Figure 6:
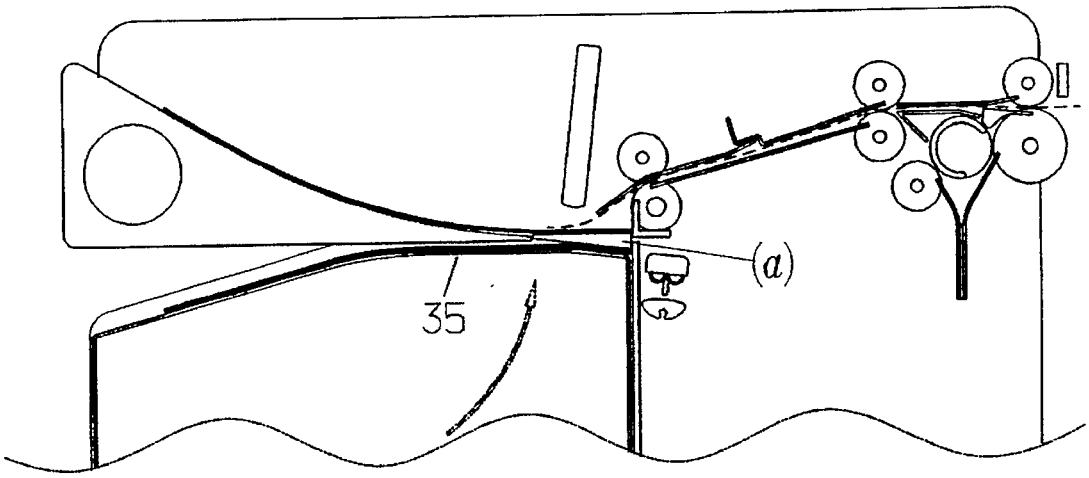

As seen in the drawings, an example of an apparatus, including the preferred components, is shown in FIGS. 1 through 5, and in FIGS. 6(*a*) through 6(*e*) there is shown how the apparatus performs the method of the invention, on a step by step basis.

The invention basically involves apparatus and a method for feeding from a source, such as a printer, or the like, sheets of paper which are to be collected in sets, the sets stapled or finished along one side of the set while a succeeding set is being assembled, and the previously finished sets then delivered to a stacker in which the sets are received, preferably in offset relation.

The sheets are fed into a set forming or assembly station 10 (FIG. 4) and formed into sets, where the trailing edges of the sets are gripped and transferred to a stapling or finishing station 20, while sheets for forming the succeeding set continue to be fed to station 10. The sets of stapled sets are then transferred to a stacker 30 and placed on the top of the previously stacked sets.

Basically, the apparatus includes a suitable frame structure F., including supporting side plates 1 and 1*a*, for supporting the set forming and transfer means 10, the stapler assembly 20 and the stacker 30, together with suitable sheet infeed means forming a sheet path through which sheets are fed via sheet infeed rolls 2 and an inverter assembly 3 driven in a suitable manner to carry sheets from a printer or other source of sheets into the apparatus. The sheets are inverted in inverter 3 when fed to the apparatus first page through last page with the printed matter facing upwardly, but if the sheets are fed last page first with printed matter facing upwardly, the inversion is not necessary.

Figure 1:
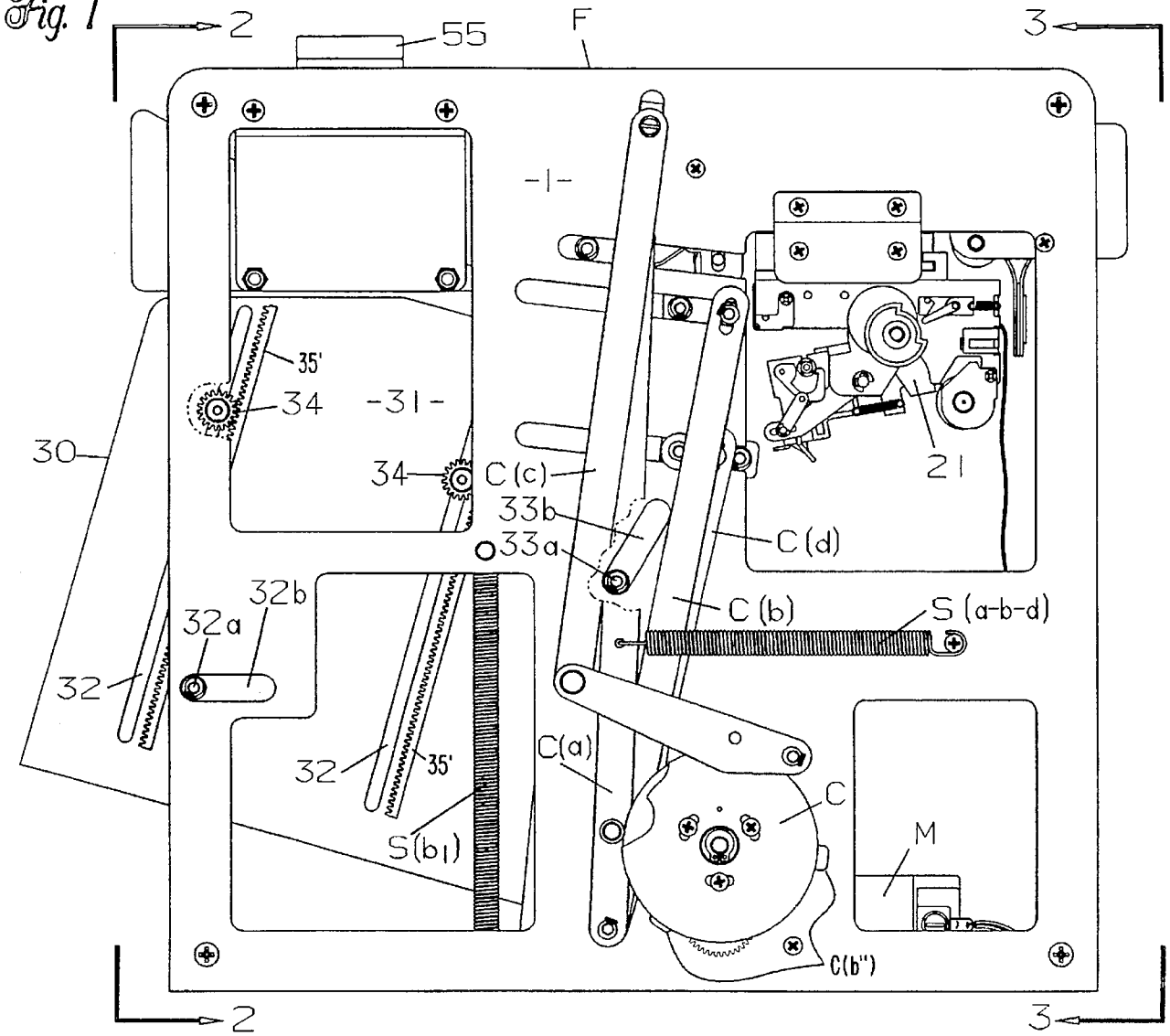
FIG. 1 is a side elevation of the apparatus embodying the present invention and adapted to perform the method described herein.
Figure 2:
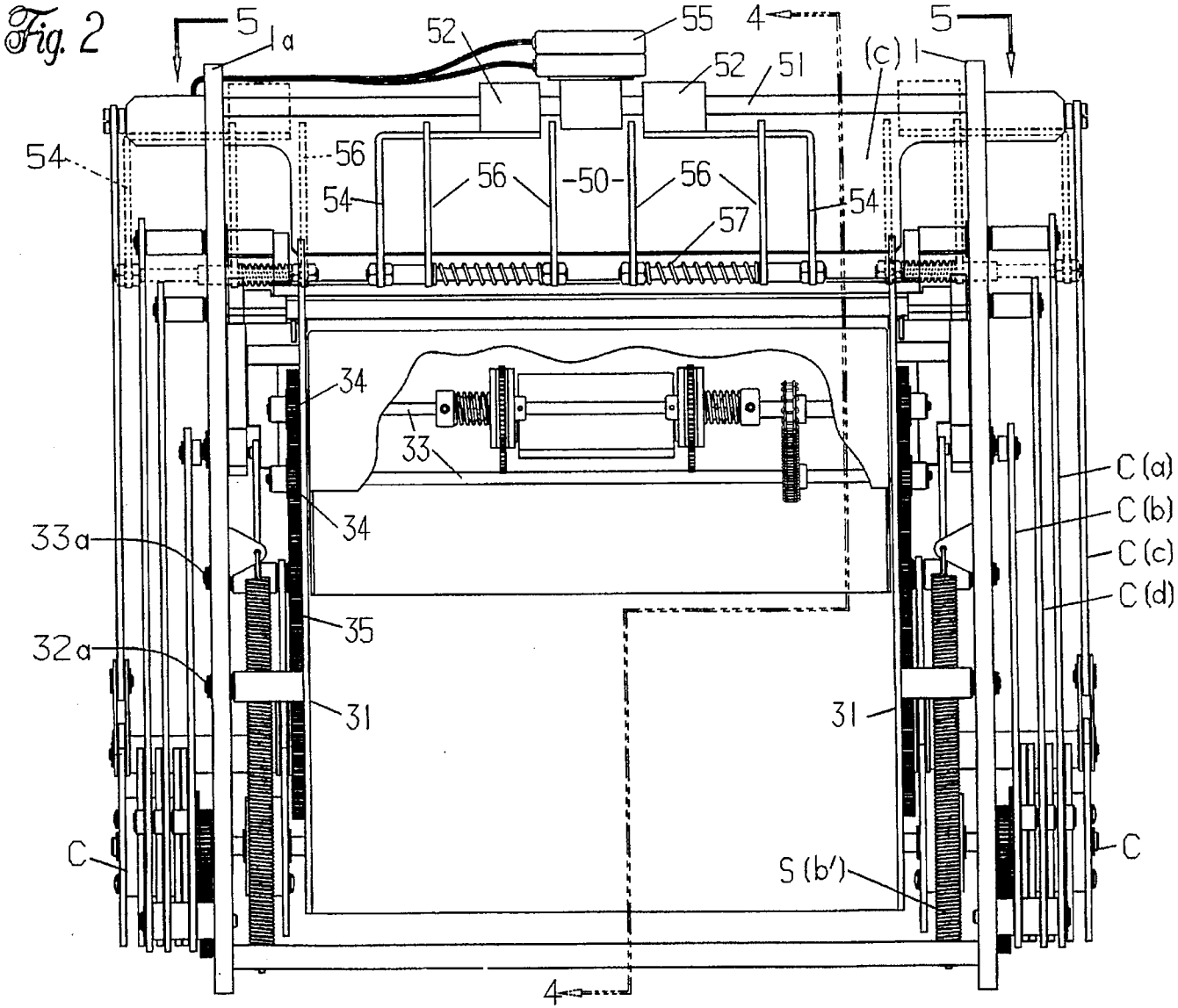
FIG. 2 is a left hand end view, exposing the interior as taken on the line 2—2 of FIG. 1.

The sheets enter the set forming station, with the leading portion of each sheet positioned over stacker 30, but as seen in FIG. 4, the leading portions of sheets are to be supported by suitable side edge jogging means 50, as later described. The trailing edges of the sheet rest on an assembly tray (a) which extends horizontally and is adapted to be reciprocated between a sheet receiving position and a retracted position, as hereinafter described. The side edge Jogging means which supports the leading portion of the sheets above the stacker is best seen in FIGS. 2, 4 and 5. A pair of horizontally extending support bars 51 extend between the side frame members 1 and 1*a* and slidably and reciprocably support vertically extended support members 52 which are relatively reciprocable by suitable means such as rack and pinion means 53, so that sheets entering between side jogging plates 54 are side edge aligned between the side plates 54 upon movement of the supports 52 towards one another. The rack and pinion means is driven by an appropriate stepper motor 55 under the control of appropriate control means.

Between the side plates 54 are elongated and arched paper support plates 56 held by springs 57 in the positions shown in FIG. 2, in full lines, but adapted to be retracted to the compressed spring positions shown in broken lines when the supporting members 52 are fully retracted or moved laterally apart in opposite directions so as to permit the leading edge of sheets supported on the arched plates 56 to pass downwardly therebetween for deposit on the stacker table top of the stacker 30.

Thus, it will be seen that sheets supplied to the apparatus through the infeed 2 move along the arched plates 56 into position between the jogging plates 54 while being supported on the plates 56 which are arched downwardly in the direction of the assembly bar (a) to assist in reverse movement of the trailing edge of sheets into the correct assembly position as successive sheets are fed into the apparatus.

Following operation of the jogging mechanism to align the side edges of the set of sheets, the Jogging mechanism is then expanded laterally, as referred to above, to deposit the leading edges of the sheets on the stacker table top 35, later described, while the trailing edges of the sheets remain in position on the assembly bar (a) for the continuing operations as described below.

The apparatus also includes means for gripping and transferring sets for engagement of the trailing edges of the sets in the stapler 21 at finishing station 20. Thus, a horizontally extended and shiftable carrier bar (b) is provided for engagement beneath the set of sheets. A horizontally extended pusher bar (c) is vertically movably supported and operable to grip sets of sheets between it and the carrier bar (b) to move the trailing edges of the sheets downwardly, following retraction of the assembly tray (a), to a position at which the pusher bar (c) is returned to its upper position and the trailing end section of the set can be gripped between carrier bar (b) and a horizontally extended set clamping bar (d) which are jointly moveable to the stapler and back to the stacker. The stacker is then moved upwardly to receive the set, all as will be more fully described below.

The sheet set receiver or assembly bar (a), carrier bar (b), pusher (c) and gripper (d) are all suitably supported for movements, as later described and means are provided for moving these components so as to appropriately receive, support and grip, move to the stapler and shift to the stacker each successive set. Various means may be employed for effecting such movements, as will be recognized by those skilled in the art, including solenoids and stepper motors and the like which can be appropriately programmed for sequencing the movements in the manners to be hereinafter described.

However, in the illustrative apparatus, sets of mechanical cams C and associated levers and links provide such sequenced drive by actuation of a single drive motor M and gearing G on a driven shaft 40 under control of a suitable control unit or signal processor. Identical cam sets C are located externally of the frame members 1 and 1*a* at each side of the apparatus. Another pair of cams C1 on the shaft 40 are provided for operation of the stacker, as will be later described. The cams C and C1 on shaft 40 enable single revolution of the shaft to effect the above referenced movements responsive to actuation of the motor M under control of a system, responsive to a cam position detector switch 41 and actuator cam 42 on shaft 40.

More particularly, the shaft 40 drives in a controlled manner cam sets C having opposite profiles for effecting timed operation of links and drives designated C(a) through C(d) which are respectively connected with members (a) through (d) for effecting the sequence of movements hereinafter described in the practice of the method of the present invention to form, engage and move the sets to the stapler 20 and from the stapler to the stacker 30.

Included in each cam set is a cam C(b") which is associated with cam C(b) and driven by timing gearing G' so that three circumferentially spaced portions of cam C(b") effect the offsetting of sets of sheets as they are being deposited in the stacker, as later described.

In order to accommodate sheet sets of different thickness it will be seen that the sheet carrier (b) is spring loaded upwardly by a spring S(b') connected between the frame and linkage C(b). The other linkages are spring loaded to normal positions by springs S(a), S(b) and S(d).

Figure 3:
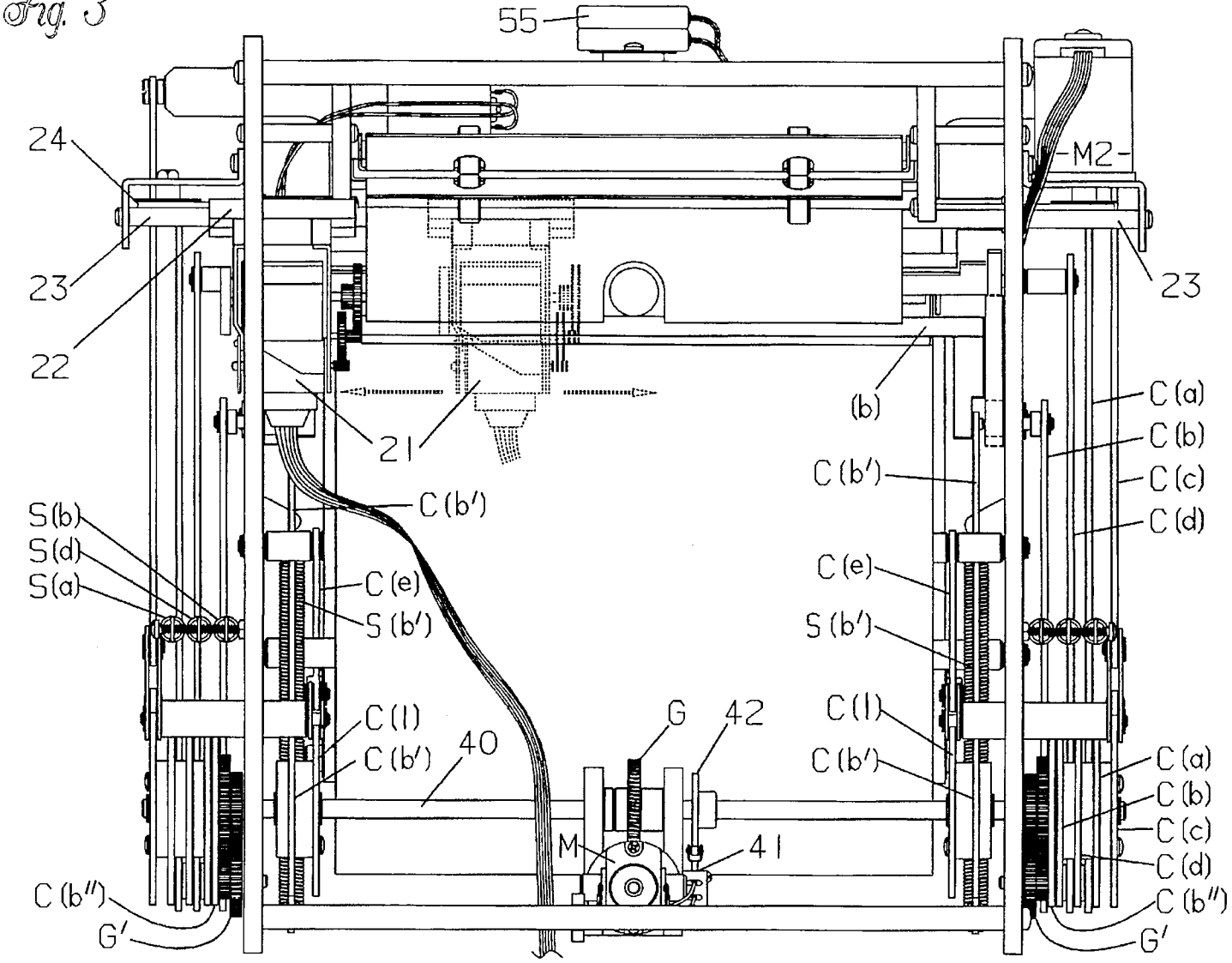
FIG. 3 is a right hand end view as taken on the line 3—3 of FIG. 1.

At the finishing station 20, it is desired that the set of sheets be finished or stapled by insertion of one or more staples into the trailing edge of the sheets in the respective sets. Referring to FIG. 3, the stapler will be seen to include a supporting block 22 mounted upon parallel shafts 23 and supporting the stapler 21 for movement by belt drive 24 and a motor M2 between a home position along the shafts 23 and one or more selected intermediate positions so as to effectively "stitch" the leading edge of the respective sets of sheets as will be later described.

At the stacker 30, the stacker is adapted to receive the stapled sets transferred from the stapler. The stacker structure includes opposed side walls 31 having vertically extended grooves 32 through which pinion shafts 33 extend supporting pinions 34 for engagement with racks 34' externally of the side walls 31 and adapted to stabilize the table 35 during upward and downward movements.

The stacker table 35 may be moved upwardly between the side walls 31 either manually or by any preferred lift mechanism so as to normally move the table 35 to a position at which it is adapted to receive the first set of sheets following stapling. The table 35 is also, as will be later more fully explained, adapted to be progressively moved downwardly as each additional set is added to the top of the table. Spring loaded one way clutches 35*a* and a one way gear 35*b* are cooperatively engaged with the table stabilizing pinions to facilitate ease of upward movement for resetting of the table to the upper position and frictional resistance to incremental downward movement of the table as successive stapled sets are added thereto.

The stacker structure is adapted to be moved generally upwardly and arcuately in a motion controlled by rollers 32*a* in horizontal slots 33*b* and rollers 33*a* in upwardly inclined slots 32*b*. Such upward movement is imparted to the stacker structure by the cam C(e) as seen in FIG. 4, C(1) on driven shaft 40 by linkage C(1) so that as later described, the stacker structure including the table 35 are moved to a position beneath the assembly bar (a) for downward relative movement of the table 35 in the supporting structure, depending on the thickness of each successive set of sheets deposited on the table.

Referring now to FIGS. 6(*a*) through 6(*l*), the steps in the performance of a sheet set forming stapling and stacking operations, will be described in detail.

First as shown in FIG. 6*a*, the paper receiving mechanism is in a neutral position allowing sheets of paper to be progressively fed through feed path F by the infeed rollers so as to accumulate a first set of sheets SS1. In the direction of infeed, the leading edges of the sheets have been extended out above the top of stacker table 35, and as shown, rest on top of the jogger mechanism which is closed or in its normal sheet receiving position. During the feeding of sheets to the assembly position, the Jogger is actuated to align successive side edges of the sheets and the trailing edges of the sheets have been deposited upon the trailing edge receiver or assembly bar (a) and end registered against backstop (a') until a complete set has been assembled. The infeed of further sheets is interrupted for a sufficient period of time to enable the next operative step.

As seen in FIG. 6(*b*), the carrier bar (b) has been moved in the direction of sheet travel and slightly upwardly for engagement beneath the set of sheets at a point spaced inwardly from the trailing edge, but beneath the upper pusher bar (c), while the trailing edge receiver or assembly bar (a) has been retracted partially from beneath registration member (a'), so that the trailing edge of the set is now supported from below and registered against the registration surface of member (a').

Referring to FIG. 6(*c*), the top pusher (c) now moves downwardly to grip the set of sheets between the top pusher and the carrier bar (b) and the receiver or assembly bar (a) has been fully retracted, but the set SS1 is supported at its trailing end on carrier bar (b) and, forwardly, the set rests upon the arched upper plates 56 of the jogger 50.

In the next step of the operation, as shown in FIG. 6(*d*) the lower carrier (b) and the top pusher (c) have, together, moved downwardly towards the table top 35 of the stacker. Also, the Jogger has been actuated to the laterally spaced positions, as indicated by the broken line illustration of sheet support 56 so that the forward portion of the set moves downwardly to rest on the table top 35 of the stacker.

Then as seen in FIG. 6(*e*), the top pusher (c) is retracted upwardly the support plates 56 are returned to their normal position, and the trailing end of the sheet set is supported on the carrier (b).

As seen in FIG. 6(*f*), clamp bar (d) then moves to a position above carrier (b). Also, assembly bar (a) moves to its sheet receiving position.

Next, as seen in FIG. 6(*g*), the carrier bar (b) moves upwardly as indicated by the arrow to clamp the trailing edge section of the set of sheets SS1 against the clamping bar (d). At this time, sheets for forming a second set of sheets SS2 are supplied to the assembly and jogging zone.

As seen in FIG. 6(*h*), the set of sheets SS1, with the trailing end clamped between members (b) and (d) is moved rearwardly into the throat of stapler 21. It should be noted that the stapler is omitted from the illustrations of the previous and succeeding steps. At the same time, additional sheets are being supplied through the paper path F for depositing the second set SS2 on assembly bar (a) and plates 56, while the stapler can be actuated to apply one or more staples to one corner of or to multiple positions along the trailing edges of the set of sheets SS1, while clamped between carrier bar (b) and clamp bar (d).

Referring to FIG. 6(*i*), it will be seen that the set SS1 is returned to stacking position on the top 35 of the stacker table, while clamped between the carrier bar (b) and the clamp (d) which are controllably returned to one of a plurality of locations as indicated by the three arrows, if it is desired to offset the position of sets on the stacker.

As seen in FIG. 6(*j*), the carrier bar (b) is then released by slight downward movement away from the clamp bar (d).

Then, as seen in FIG. 6(*k*), the clamp bar (d) and the carrier (b) are both retracted to their original position so that the set SS1 gravitates to the top 35 of the stacker.

Thereafter, the stacker is raised as shown in FIG. 6(*l*) and the top 35 is depressed an amount equal to the thickness of the set SS1 by engagement of the set of sheets beneath the assembly receiver tray (a) such depression being permitted by the spring loaded slip clutches which normally hold the table in its raised position but allow progressive downward movement of the table to a new position, depending upon the thickness of each successive set of sheets.

Thereafter, the operations are repeated for clamping and transferring the set SS2 to the stapler and returning the set SS2 to a position for depositing the same upon the top of set SS1 at a selected one of three positions.

Having thus described the method an an illustrative embodiment of the apparatus, what is sought to be covered is best defined in the appended claims.

I claim:

1. Sheet stacking and finishing apparatus for receiving successive paper sheets from a host printer, forming sets, finishing and stacking said sets, comprising: stacker means, feed means for supplying the leading edge of sheets to the apparatus, support means for receiving the trailing edges of said sheets to assemble said sets and movable to a position from beneath the trailing edge of said sets for depositing the sets on said stacker means, finishing means adjacent to said stacker means, set carrier means movable between positions adjacent to said finisher means and beneath the trailing edge of said sets, set clamping means cooperative with said carrier means for gripping the trailing edge of said sets, said carrier means and clamping means being shiftable towards said finisher means, said finisher means being operable to finish the trailing edge of said sets while engaged between said carrier means and said clamping means, said carrier means and said clamping means also being movable to position said sets following finishing thereof for stacking on said stacker means, and means for feeding sheets to said support means and said stacker means as said carrier means and clamping means move a previously finished set from said finishing means to said stacker means.

2. A sheet stacker and finishing apparatus as defined in claim 1, said stacker means having a support table for receiving said sets, and means normally holding said support table in an upper position for receiving successive sets and for movement downwardly to accommodate succeeding sets depending upon the thickness of each set.

3. A sheet stacker and finishing apparatus as defined in claim 1, said stacker means having a support table for receiving said sets, and means normally holding said support table in an upper position for receiving successive sets and movable downwardly to accommodate succeeding sets, including means for moving said stacker means upwardly, and means disposed above said table and operative to engage a set of sheets on said table to push said table downwardly a distance equal to the thickness of said set upon upward movement of said stacker means.

4. A sheet stacker and finishing apparatus as defined in claim 1, wherein said finishing means is an automatic stapler.

5. A sheet stacker and finishing apparatus as defined in claim 1, wherein said finishing means is an automatic stapler, including means supporting said stapler for movement transversely of the trailing edge of said sets for applying staples.

6. A sheet stacker and finishing apparatus as defined in claim 1, wherein said carrier means and said clamping means move finished sets to said stacker means to a plurality of offset positions.

7. A sheet stacker and finishing apparatus as defined in claim 1, wherein said apparatus includes means for receiving and supporting sheets above said stacker means and for releasing sets of sheets for deposit on said stacker means.

8. A sheet stacker and finishing apparatus as defined in claim 1, wherein said apparatus includes means for receiving and supporting sheets above said stacker means and for releasing sets of sheets for deposit on said stacker means, said means for receiving and supporting sheets being operable to jog said sheets for alignment of the side edges of set of sheets.

9. A sheet stacker and finishing apparatus as defined in claim 1, wherein said apparatus includes means for receiving and supporting sheets above said stacker means and for releasing sets of sheets for deposit on said stacker means, said means for receiving and supporting sheets being operable to jog said sheets for alignment of the side edges of set of sheets, said means for receiving and supporting sheets also including an arched support for receiving sheets and causing movement thereof in the opposite direction from said feed means, and registration means for the trailing edges of said sheets engageable with said sheets responsive to movement thereof in said opposite direction.

10. The method of stacking successive finished sets of sheets supplied from a host printer to a stacker, comprising the steps of: feeding successive sheets of paper to an assembly station, supporting the trailing edges of said sheets above said stacker, gripping the trailing edges of a first set of sheets and moving said trailing edges to a finishing station while feeding a second succession of sheets to said assembly station to form a second set, finishing said trailing edges of said first set, moving said first set from said finishing station to said stacker, depositing said first set on said stacker and repeating said gripping, moving, finishing, moving and depositing steps on said second set.

11. The method as defined in claim 10, including moving the successive sets on said stacker downwardly a distance equal to the thickness of each successive set.

12. The method as defined in claim 10, including stapling the trailing edges of said sheets at said finishing station.

13. The method as defined in claim 10, including depositing said sets on said stacker in offset relation.

14. The method of continuously assembling, finishing and stacking successive finished sets of sheets supplied from a host printer to a Stacker, comprising the steps of: feeding successive sheets of paper to an assembly station to assemble a first set of sheets, moving said first set of sheets from said assembly station to a finishing station while feeding a second succession of sheets to said assembly station to form a second set, finishing said first set, moving said first set from said finishing station to said stacker, depositing said first set on said stacker and repeating said moving, finishing, moving and depositing steps on said second set.

* * * * *